US006148796A

United States Patent [19]

Krimmer et al.

[11] Patent Number: 6,148,796

[45] Date of Patent: Nov. 21, 2000

[54] SWITCHING MAGNET FOR A HIGH PRESSURE PUMP

[75] Inventors: Erwin Krimmer, Pluederhausen; Tilman Miehle, Kernen, both of Germany

[73] Assignee: Robert Bosch GmbH, Stuttgart, Germany

[21] Appl. No.: 09/228,190

[22] Filed: Jan. 11, 1999

[51] Int. Cl.[7] ..... F02M 33/04

[52] U.S. Cl. ..... 123/446; 123/458

[58] Field of Search ..... 123/449, 446, 123/458, 198 DB, 456; 251/129.07, 50

[56] References Cited

U.S. PATENT DOCUMENTS

| | | | |
|---|---|---|---|
| 4,411,406 | 10/1983 | Inada et al. | 251/129.07 |
| 4,832,312 | 5/1989 | Linder et al. | 251/129.07 |
| 4,953,825 | 9/1990 | Osumi et al. | 251/129.07 |
| 5,476,245 | 12/1995 | Augustin | 251/129.07 |
| 5,533,480 | 7/1996 | Jenkins | 251/129.07 |

FOREIGN PATENT DOCUMENTS 451 227 B1 12/1994 European Pat. Off. .

*Primary Examiner*—Thomas Moulis
*Attorney, Agent, or Firm*—Ronald E. Greigg; Edwin E. Greigg

[57] ABSTRACT

A switching magnet with which a valve reed of a high-pressure pump is lifted from a seat in order to switch off a pump element of the high-pressure pump. The switching magnet is disposed in a housing that is manufactured as a plastic injection-molded part. An armature that floats in an armature chamber and a brass sleeve are disposed on the inside of the housing and the brass sleeve is turned upside down over a pole piece. The pole piece supports an O-ring, which rests against the inside of the brass sleeve and seals the armature chamber in relation to the outside and in relation to the coil. A second O-ring seals a passage of the tappet in relation to a pump cover of the high-pressure pump. The switching magnet is designated for use in a high-pressure pump of a common rail injection system of an internal combustion engine.

19 Claims, 2 Drawing Sheets

SWITCHING MAGNET FOR A HIGH PRESSURE PUMP

BACKGROUND OF THE INVENTION

The invention relates to a switching magnet for a high-pressure pump. A switching magnet of this kind is contained in a prior application.

A switching magnet of this kind is used to monitor the supply onset of the high-pressure pump by virtue of the fact that by way of an intake valve that is opened by the intake current, the supply of fuel into a high-pressure reservoir can be intermittently interrupted in order to be able to establish the supply time. A conventional magnet is used as the switching magnet. A magnet of this kind is hardly protected from corrosive environmental influences. In addition, it has the disadvantage that the vibrational stresses occurring in a common rail system loosen the wires of the coil so that they rub against one another. In addition, the known magnet is relatively large and heavy.

OBJECT AND SUMMARY OF THE INVENTION

The switching magnet according to the invention has the advantage over the prior art that it is very small and light, that it requires very little energy, and that it is protected from damaging influences.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
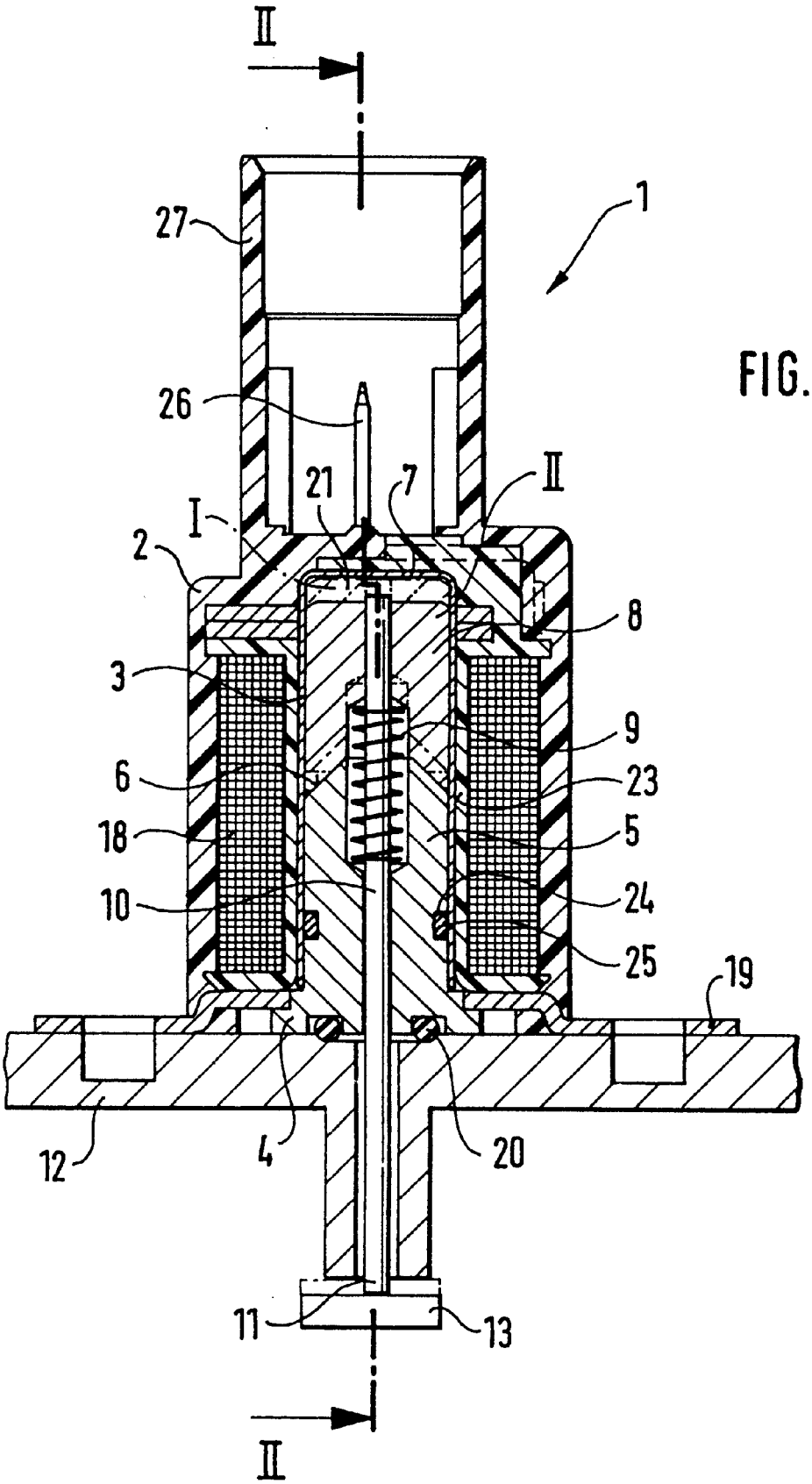
FIG. 1 shows the switching magnet in a sectional view.

A switching magnet 1 has a hat-shaped housing 2 into which a likewise hat-shaped brass sleeve 3 and a pole piece 5 provided with a flange 4 are inserted from underneath. An armature 8 is disposed between an upper conical face 6 of the pole piece 5 and an end wall 7 of the brass sleeve 3, and is subjected to the force of a spring 9, which seeks to push the armature upward away from the pole piece 5. A tappet 10 is attached in the armature 8 and with its free end 11, protrudes through the pole piece 5 and through a pump cover 12, which is disposed under the pole piece 5 and belongs to a high-pressure pump that is not shown in detail, and engages a valve reed 13 in the pump, which belongs to an intake valve that is likewise not shown.

A bracket 15, which has a complex structure, is stamped out of sheet metal, and is provided with a fold 14 in its upper part. The fold is disposed on the brass sleeve 3 (also see FIG. 2), which receives a coil 18 between two flanges 16 and 17. At the bottom, the bracket 15 sits on a slightly crimped securing plate 19, which rests on the pump cover 12, wherein the securing plate 19 is screwed to the pump cover 12 and the flange 4 is disposed on the inside and has an annular recess into which an O-ring 20 is inserted. The O-ring seals the passage of the tappet 10 and therefore seals the interior of the switching magnet 1 in relation to the outside.

The armature 8 is disposed in an armature chamber 21, which is filled with fluid, e.g. fuel, so that the armature 8 floats in the fuel. For pressure compensation, the armature 8 is provided with a compensation bore 22 that runs at least largely parallel to the axis. An annular groove 24 is formed into a circumferential surface 23 of the pole piece 5 and contains a second O-ring 25. The O-ring rests against the inside of the brass sleeve 3 and seals the armature chamber 21 in relation to the coil 18 and the outside.

At the top, electrical connections 26 for the switching magnet 1 are inserted into the housing 2, which are covered and protected by a sleeve extension 27. The entire housing 2 with the sleeve extension 27 is comprised of plastic and is manufactured in one injection molding work cycle. In this manner, most of the parts of the switching magnet are extrusion coated and are held together mechanically by the housing 2. This permits an inexpensive manufacture of the switching magnet 1 and the plug connection in the sleeve extension 27. The extrusion coating also assures a protection of the contacts from corrosive environmental influences. Finally, the extrusion coating also protects the winding from corrosive environmental influences and from the vibrational stresses occurring in a common rail system by virtue of the fact that the wires are fixed in place and cannot rub against one another.

The fold 14 of the bracket 15 assures a favorable magnetic transition to the armature 8, which allows the switching magnet 1 to be designed so that it is light and small. Furthermore, the sealing of the switching magnet 1 with the two O-rings 20 and 25 and the brass sleeve 3 assures an absolute imperviousness of the switching magnet 1 in relation to the outside and in relation to the overpressure of 2 to 4 bar prevailing in the low-pressure circuit. The compensation bore 22 in the armature 8 produces an easy mobility of the armature 8 in the armature chamber 21, which accelerates the switching.

MANNER OF OPERATION

Figure 2:
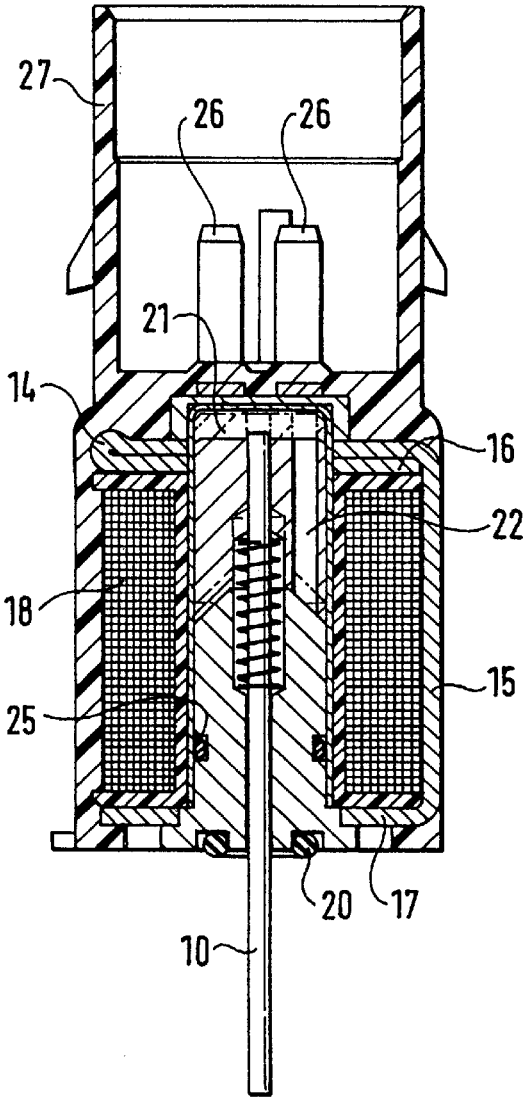
FIG. 2 shows a section along the line II—II in FIG. 1.
Figure 3:
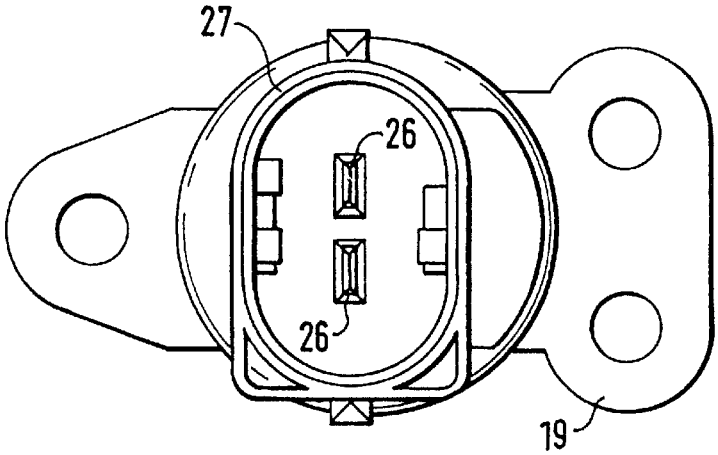
FIG. 3 is a top view of the switching magnet.

In FIGS. 1 and 2 respectively, the rest position I of the switching magnet is represented to the left of the center line and the switched position II of the switching magnet is represented to the right of the center line.

A magnetic field is generated by supplying the coil 18 with power. This magnetic field is conducted by the bracket 15, the pole piece 5, and the armature 8 so that the armature 8 moves from the rest position I into the switched position II. As a result, the tappet 10 then lifts the valve reed 13 from its seat in the pump cover 12 of the common rail high-pressure pump so that a pump element of the high-pressure pump is switched off.

When the power supply is switched off, the spring 9 brings the armature 8, together with the tappet, back into its rest position.

The switching magnet 1 is screwed to the pump cover 12 by way of the bracket 15. With the O-ring 20, the pole piece 5 seals the inner chamber of the switching magnet 1 off from the pump cover 12. Another seal is produced with the O-ring 25 and the brass sleeve 3. In addition, this brass sleeve 3 is simultaneously used as a slide bearing element for the armature 8. The compensation bore 22 makes a rapid switching of the switching magnet 1 possible.

The foregoing relates to preferred exemplary embodiments of the invention, it being understood that other variants and embodiments thereof are possible within the spirit and scope of the invention, the latter being defined by the appended claims.

Reference Numeral List

1 switching magnet
2 housing
3 brass sleeve
4 flange
5 pole piece
6 conical face
7 end wall
8 armature
9 spring
10 tappet
11 end
12 pump cover
13 valve reed
14 fold
15 bracket
16 flange
17 flange
18 coil
19 securing plate
20 O-ring
21 armature chamber
22 compensation bore
23 circumferential surface
24 annular groove
25 O-ring
26 connections
27 sleeve extension

We claim:

1. A switching magnet for a high-pressure pump of a common rail injection system of an internal combustion engine, comprising an intake valve to which a tappet of the switching magnet is connected, with which the function of the intake valve can be switched off, the tappet (10) is functionally connected to an armature (8) of the switching magnet (1), which is disposed floating in a fuel.

2. The switching magnet according to claim 1, in which the armature (8) is moved in a fuel-filled brass sleeve (3) that is sealed off from an outside.

3. The switching magnet according to claim 2, in which the brass sleeve (3) is embodied as cup-shaped and covers a pole piece (5) into whose circumferential surface (23) an O-ring (25) is inserted, said O-ring produces a seal in relation to the brass sleeve (3).

4. The switching magnet according to claim 3, in which the pole piece (5) is sealed in relation to a pump cover (12) of the high-pressure pump by means of a second O-ring (20).

5. The switching magnet according to claim 1, in which the armature (8) is provided with a compensation bore (22) that runs at least largely parallel to the axis.

6. The switching magnet according to claim 1, in which a bracket (15) that overlaps the switching magnet (1) is a sheet metal part that is folded several times in a region of the armature (8).

7. A circuit according to claim 1, in which a housing (2) of the switching magnet (1) is manufactured out of plastic in an injection molding process.

8. The switching magnet according to claim 2, in which the armature (8) is provided with a compensation bore (22) that runs at least largely parallel to the axis.

9. The switching magnet according to claim 3, in which the armature (8) is provided with a compensation bore (22) that runs at least largely parallel to the axis.

10. The switching magnet according to claim 4, in which the armature (8) is provided with a compensation bore (22) that runs at least largely parallel to the axis.

11. The switching magnet according to claim 2, in which a bracket (15) that overlaps the switching magnet (1) is a sheet metal part that is folded several times in a region of the armature (8).

12. The switching magnet according to claim 3, in which a bracket (15) that overlaps the switching magnet (1) is a sheet metal part that is folded several times in a region of the armature (8).

13. The switching magnet according to claim 4, in which a bracket (15) that overlaps the switching magnet (1) is a sheet metal part that is folded several times in a region of the armature (8).

14. The switching magnet according to claim 5, in which a bracket (15) that overlaps the switching magnet (1) is a sheet metal part that is folded several times in a region of the armature (8).

15. A circuit according to claim 2, in which a housing (2) of the switching magnet (1) is manufactured out of plastic in an injection molding process.

16. A circuit according to claim 3, in which a housing (2) of the switching magnet (1) is manufactured out of plastic in an injection molding process.

17. A circuit according to claim 4, in which a housing (2) of the switching magnet (1) is manufactured out of plastic in an injection molding process.

18. A circuit according to claim 5, in which a housing (2) of the switching magnet (1) is manufactured out of plastic in an injection molding process.

19. A circuit according to claim 6, in which a housing (2) of the switching magnet (1) is manufactured out of plastic in an injection molding process.

* * * * *